US009792891B2

(12) United States Patent
Swinkels et al.

(10) Patent No.: US 9,792,891 B2
(45) Date of Patent: Oct. 17, 2017

(54) ACOUSTIC PANEL HAVING LIGHTING PROPERTIES

(71) Applicant: PHILIPS LIGHTING HOLDING B.V., Eindhoven (NL)

(72) Inventors: Stefan Henricus Swinkels, Valkenswaard (NL); Michel Cornelis Josephus Marie Vissenberg, Roermond (NL)

(73) Assignee: PHILIPS LIGHTING HOLDING B.V., Eindhoven (NL)

( * ) Notice: Subject to any disclaimer, the term of this patent is extended or adjusted under 35 U.S.C. 154(b) by 0 days.

(21) Appl. No.: 14/409,004

(22) PCT Filed: Jun. 17, 2013

(86) PCT No.: PCT/IB2013/054950
§ 371 (c)(1),
(2) Date: Dec. 18, 2014

(87) PCT Pub. No.: WO2013/190447
PCT Pub. Date: Dec. 27, 2013

(65) Prior Publication Data

US 2015/0136521 A1 May 21, 2015

Related U.S. Application Data

(60) Provisional application No. 61/661,878, filed on Jun. 20, 2012.

(51) Int. Cl.
*F21V 21/02* (2006.01)
*G10K 11/172* (2006.01)
(Continued)

(52) U.S. Cl.
CPC ..... *G10K 11/172* (2013.01); *E04B 1/86* (2013.01); *E04C 2/324* (2013.01); *F21V 7/22* (2013.01);
(Continued)

(58) Field of Classification Search
CPC ..... F21Y 2105/00; F21S 8/04; F21S 8/043; F21S 8/033; F21S 8/03; F21V 21/02;
(Continued)

(56) References Cited

U.S. PATENT DOCUMENTS 2,306,685 A * 12/1942 Chambers ..... E04B 9/001 181/293
4,114,725 A * 9/1978 Croasdale ..... E04B 1/8227 181/205
(Continued)

FOREIGN PATENT DOCUMENTS

CN 201462755 U 5/2010
DE 102007043716 A1 3/2009
(Continued)

OTHER PUBLICATIONS

P. Virjonen et al; "Determination of Acoustical Conditions in Open-Plan Offices: Proposal for New Measurement Method and Target Values", Acta Acustica United With Acustica, vol. 95, pp. 279-290, Dec. 16, 2008.
(Continued)

*Primary Examiner* — Edgardo San Martin

(57) ABSTRACT

The invention provides an acoustic panel comprising a plurality of parallel-arranged elongated cavities, wherein each cavity has a first cavity wall and a second cavity wall tapering to a cavity back end and defining a cavity opening angle (γ) having a value in the range of 0°<γ<90°, wherein the first cavity wall and the second cavity wall comprise a light-reflective material, wherein each elongated cavity at
(Continued)

the cavity back end of the elongated cavity accommodates a light source having a light exit surface, wherein the first cavity walls hide the light exit surfaces of the light sources when the acoustic panel is viewed along a normal to the acoustic panel, and wherein the acoustic panel further comprises sound reducing material.

18 Claims, 7 Drawing Sheets

(51) Int. Cl.

| | |
|---|---|
| ***E04C 2/32*** | (2006.01) |
| ***E04B 1/86*** | (2006.01) |
| ***F21V 33/00*** | (2006.01) |
| ***F21V 7/22*** | (2006.01) |
| *F21V 21/00* | (2006.01) |
| *E04B 2/74* | (2006.01) |
| *E04B 1/84* | (2006.01) |
| *F21V 7/00* | (2006.01) |
| *F21V 11/02* | (2006.01) |
| *F21Y 115/30* | (2016.01) |
| *F21Y 115/10* | (2016.01) |

(52) U.S. Cl.
CPC ..... *F21V 33/006* (2013.01); *E04B 2/7403* (2013.01); *E04B 2/7405* (2013.01); *E04B 2001/849* (2013.01); *F21V 7/005* (2013.01); *F21V 7/0083* (2013.01); *F21V 11/02* (2013.01); *F21Y 2115/10* (2016.08); *F21Y 2115/30* (2016.08)

(58) Field of Classification Search
CPC .... F21V 21/047; F21V 21/041; F21V 33/006; E04B 2002/7487
USPC ..... 181/289, 293, 284, 285, 288, 287, 290
See application file for complete search history.

(56) References Cited

U.S. PATENT DOCUMENTS 4,214,298 A * 7/1980 Propst ..... F21V 33/0056 362/253
4,274,506 A * 6/1981 Blomgren ..... E01F 8/0029 181/210
4,680,685 A * 7/1987 Altman ..... F21S 8/00 362/240
4,816,969 A * 3/1989 Miller ..... F21S 8/033 362/130
4,971,850 A * 11/1990 Kuan-Hong ..... E04B 1/86 181/284
5,171,084 A * 12/1992 Burkarth ..... B60H 1/00371 362/149
5,255,478 A * 10/1993 Baranowski ..... A47B 83/001 52/239
6,331,063 B1 * 12/2001 Kamada ..... F21V 5/02 257/E25.02
6,615,951 B1 * 9/2003 Boutin ..... E04B 1/86 181/293
6,789,646 B2 * 9/2004 Wang ..... G10K 11/172 181/293
8,287,146 B2 * 10/2012 Hysky ..... E04B 9/366 181/211
8,967,823 B2 * 3/2015 D'Antonio ..... E04B 9/32 362/147
9,147,390 B2 * 9/2015 Swinkels ..... G10K 11/172
2008/0266842 A1 * 10/2008 Skidmore ..... E04B 9/32 362/147
2010/0110674 A1 * 5/2010 Hysky ..... E04B 9/366 362/234
2013/0201690 A1 * 8/2013 Vissenberg ..... E04B 9/0464 362/296.07
2014/0226360 A1 * 8/2014 Krijn ..... F21V 33/006 362/555
2014/0299408 A1 * 10/2014 Swinkels ..... G10K 11/172 181/289
2015/0109765 A1 * 4/2015 Sepkhanov ..... E04B 1/86 362/147

FOREIGN PATENT DOCUMENTS

DE 102008026504 * 12/2009 ..... E04B 9/006
DE 202008008896 U1 3/2010
EP 2375151 A2 10/2011
JP 10214517 A 8/1998
JP 2009021029 A 1/2009
NL EP 2653775 A1 * 10/2013 ..... E04B 9/32

OTHER PUBLICATIONS

Dah-You Maa; "Potential of Microperforated Panel Absorber", Institute of Acoustics, Journal Acoustic Soc. Am. vol. 104, No. 5, Nov. 1998, pp. 2861-2866.
Annu Haapakangas et al; "Perceived Acoustic Environment, Work Performance and Well-Being-Survey Results From Finnish Offices", Performance, 9th International Congress on Noise as a Public Health Problem, ICBEN, 2008, Foxwoods, CT, USA. pp. 1-8.

* cited by examiner

ACOUSTIC PANEL HAVING LIGHTING PROPERTIES

CROSS-REFERENCE TO PRIOR APPLICATIONS

This application is the U.S. National Phase application under 35 U.S.C. §371 of International Application No. PCT/IB13/054950, filed on Jun. 17, 2013, which claims the benefit of U.S. Provisional Patent Application No. 61/661,878, filed on Jun. 20, 2012. These applications are hereby incorporated by reference herein.

FIELD OF THE INVENTION

The invention relates to an acoustic panel and to its use.

BACKGROUND OF THE INVENTION

Acoustic panels are well known in the art. US2003163967, for instance, describes a jointing assembly for a panel screen or room divider system comprising a first frame member with a longitudinally extending recess having a narrow slot, wherein a tenon-piece is received. The tenon-piece engages with a slot-like recess formed in a second frame member. The screen or room-divider further comprises at least one panel member having a flange on its edge, which is slidably engageable within a recess of the second frame member. The screen or room-divider comprises at least two vertical frame members, each provided with recesses formed therein, and at least two linking members with flanges shaped to fit within the recesses. The end surfaces of the linking members are inclined, tending to produce a wedging action when positioned end to end.

SUMMARY OF THE INVENTION

An increasing number of office workers are located nowadays in open plan offices. In such offices an often heard complaint is that people have difficulties in doing their job because of annoying and distracting sounds around them. The most distracting sound source in open-plan offices is speech, in particular speech resulting from meetings of people. In order to block the sound of speech in the open space, acoustic reducing, such as sound absorbing or sound blocking, divider walls may be placed on the desks and/or in between desks.

A problem related to the divider walls is that they also block light. This reduces the task lighting level at the desks (by blocking the light from the ceiling luminaires to the desk) but it also blocks the view, e.g. to the outside windows. The latter effect may cause fatigue or eye strain, because of the low luminance of the divider wall compared to the luminance of a computer screen.

Common solutions to these problems are a desk light to provide additional task lighting and lighting integrated under cabinets or shelves to illuminate the desk and the divider walls. Such lighting may not provide the desired light distribution.

Hence, it is an aspect of the invention to provide an alternative acoustic panel, which especially further obviates at least partly one or more of the above-described drawbacks.

The divider wall according to the present invention has two main aims. First, the annoyance of the people evoked by speech and other sounds is reduced by e.g. absorbing and/or blocking sound waves that would otherwise propagate from one desk to another. Second, the light that may be blocked by the divider wall is compensated by an integrated substantially glare-free task light and a soft wall luminance. The integrated lighting functionality may be used to bring back the lighting level to the minimum required levels (e.g. 500 lux task illumination at a desk) but it may also be used to boost the light level in areas where there is little daylight, in order to increase the well-being of people. Furthermore, the soft luminous effect may be used to reduce the eye strain caused by the contrast between a bright computer screen and a dark divider wall. Finally, it is also an object of the invention to reduce the cluttering of the office space by integrating the additional lighting functions (desk light, wall light) into the furniture (the divider wall).

The invention provides a sound reducing panel, such as a sound absorbing and/or sound blocking panel that, in an embodiment, consists of a rigid back plane (that may also block sound and/or may especially provide mechanical stability) covered by a thick (e.g. 1-10 cm) sound reducing material layer (e.g. melamine foam or glass wool). The sound reducing layer contains elongated (tapered) funnels or slits (herein also indicated as elongated cavities) through the layer that, in an embodiment, are coated with an optically diffuse reflecting layer (e.g. white paint or non-woven fibers). The elongated cavities may especially taper in a direction perpendicular to an elongated cavity axis, and especially each elongated cavity accommodates one or more light sources arranged at a back end of the cavity, providing (when lit) light from the (wider end of the) cavity opening of the elongated cavity over a substantial part of the length of the elongated cavity. The elongated cavities can thus be seen as a kind of elongated (asymmetric) collimators. In an embodiment, light sources are mounted on a back plane (which may also function as a heat sink), aligned with cavity back ends, such as the narrow ends of the tapered funnels or slits. The light of the light source may thus be directed from the cavity back end to the cavity opening; however, lighting may be direct or indirect (via the walls of the elongated cavities).

In an embodiment, tapered funnels or slits are applied. The tapered funnels or slits (i.e. the elongated (tapered) cavities) are asymmetric at least in the sense that they are tilted with respect to a normal to the panel. Therefore, one side of the funnel/slit may block a direct view onto the light source, thus avoiding (direct) glare. The diffusely reflecting funnels/slits provide a direct lighting component (the light that is not blocked by a funnel side, e.g. to be used for task lighting) as well as an indirect, diffuse lighting component (that may create a glow effect ("soft luminous", see also above)). Hence, in an embodiment, the bisector plane of one or more of the (tapered) cavities, especially of all (tapered) cavities, are tilted with respect to a normal to the panel.

This effect may in principle also be achieved when the cavities do not taper, because a cavity wall may still block direct view in the light source. For instance, both cavity walls may be tilted with respect to a normal to the panel.

Hence, in a first aspect, the invention provides an acoustic panel comprising one or more elongated cavities, wherein each cavity has a first cavity wall, a second cavity wall, a cavity opening between the first cavity wall and the second cavity wall, and a cavity back end (also indicated as "back end"), wherein for one or more of the elongated cavities, especially for all of them, it holds that the elongated cavity accommodates, at the cavity back end, a light source having a light exit surface, wherein the light source is configured to provide light source light that can emanate from the cavity opening, wherein the first cavity wall or the second cavity wall (of said one or more of the elongated cavities that accommodate the light source(s)) hide the light exit surface of the light source when the acoustic panel is viewed along a normal to the acoustic panel, and wherein the acoustic panel further comprises sound reducing material.

In a specific embodiment, for each of the elongated cavities it holds that the elongated cavity accommodates, at the cavity back end, a light source having a light exit surface, wherein the light source is configured to provide light source light that can emanate from the cavity opening, wherein the first cavity wall or the second cavity wall hide the light exit surface of the light source when the acoustic panel is viewed along a normal to the acoustic panel.

In an embodiment, one or more of the one or more first cavity walls and the one or more second cavity walls comprise sound reducing material.

As indicated above, such acoustic panels advantageously can be used in offices or other rooms to reduce sound, and thereby improve the acoustics and the well-being of persons in such rooms, while also lighting can be improved, which may also improve the well-being of the persons in such rooms. The acoustic panel may especially be used as desk divider or room divider. In such an embodiment, the acoustic panel may for instance be arranged on a desk. Further, the acoustic panel may thus be used to enhance the visual and acoustic privacy in an open office and at the same time to provide task light at a desk.

In an embodiment, the first cavity wall can be seen as upper cavity wall, and the second cavity wall can be seen as lower cavity wall. In case the elongated cavity tapers, the cavity back end can be seen as the taper end of the elongated cavity.

Especially, for one or more of the elongated cavities, particularly for all of them, it holds that the first cavity wall and the second cavity wall comprise a light reflective material; especially diffusely reflective material (also see further below). Of course, this may especially apply to those (one or more) elongated cavities that accommodate a light source.

As indicated above, each cavity has a first cavity wall, a second cavity wall, a cavity opening between the first cavity wall and the second cavity wall, and a cavity back end. When an elongated cavity accommodates a light source, the light source in the elongated cavity is especially configured to provide light source light that emanates from the cavity opening. Hence, light from the light source, i.e. the light source light, travels from the cavity back end to the cavity opening and "escapes" therefrom. This may be direct light, but light emanating from the cavity opening may also be indirect light, i.e. light from the light source that escapes from the cavity opening after one or more reflections from one or more of the first cavity wall and the second cavity wall. Hence, especially for this reason diffusely reflective material may be applied as cavity walls or as a layer to the cavity walls.

The first cavity wall and the second cavity wall may be arranged in parallel or may be arranged in a tapering way (tapering from the cavity opening to the cavity back end). Hence, the first cavity wall and the second cavity wall may have a mutual angle or cavity opening angle taper to the cavity back end and define a cavity opening angle (•) having a value in the range of 0°••<90°, especially 0°<•<90°, even more especially 35°•••75°. The cavity opening angle may vary with cavity length, but alternatively or additionally may also vary from elongated cavity to elongated cavity. When viewed from a distance, still no direct light may be perceived. For instance, the phrase "viewed along a normal" especially relates to an observer arranged at a distance from the panel of 20 times the height of the panel. This is further explained below.

Hence, in a specific embodiment, the invention provides an acoustic panel wherein for one or more of the elongated cavities, especially for all of them, it holds that the first cavity wall and the second cavity wall taper to the cavity back end and define a cavity opening angle (•) having a value in the range of 0°<•<90°. As indicated above, especially 35°•••75°.

In a further specific embodiment, the elongated cavities are arranged in parallel. Hence, in such an embodiment the elongated cavity axes of the elongated cavities are arranged in parallel, and may be arranged in a single plane.

Hence, in a specific embodiment, the invention provides an acoustic panel comprising one or more, especially a plurality of, especially parallel-arranged, elongated cavities, wherein (the) each cavity has a first cavity wall and a second cavity wall (the first cavity wall and the second cavity wall) especially tapering to a cavity back end and (the first cavity wall and the second cavity wall) defining a cavity opening angle (•) having a value especially in the range of 0°<•<90°, such as in the range of 35-75°, wherein the first cavity wall and the second cavity wall especially comprise a light reflective material, wherein especially each elongated cavity at the cavity back end of the elongated cavity accommodates a light source having a light exit surface, wherein the first cavity wall(s) hide the light exit surface(s) of the light source(s) when the acoustic panel is viewed along a normal to the acoustic panel, and wherein the acoustic panel further comprises sound reducing material.

Especially, the invention provides an acoustic panel comprising a support frame with parallel-arranged elongated bars connected to said support frame, said elongated bars comprising sound reducing material, said elongated bars further being configured to provide an elongated cavity between two adjacent elongated bars, wherein the acoustic panel comprises a plurality of said elongated cavities (and thus especially • elongated bars). Especially, herein each cavity has a first cavity wall and a second cavity wall tapering in the direction of the support frame and defining a cavity opening angle (•) having a value in the range of 0°<•<90°, such as in the range of 35-75°, wherein the first cavity wall and the second cavity wall comprise a light reflective material, wherein each elongated cavity at a cavity back end of the cavity accommodates a light source having a light exit surface, wherein the first cavity walls hide the light exit surfaces of the light sources when the acoustic panel is viewed along a normal to the support frame.

The term acoustic panel refers to a panel, in general a square or rectangular panel, having properties to reduce sound. Below, a number of sound reducing materials are described.

Different types of sound reducing materials may be applied.

Sound absorber materials or sound absorbing materials eliminate sound reflections and are generally porous, with many pathways that redirect sound and cause it to lose energy. Typical sound absorbing materials are fiberglass, rock wool, open cell polyurethane foam, cellular melamine foam, heavy curtain blankets and thick fabric wall coverings. Absorber materials do not substantially block sound, but sound absorption can enhance isolation by stopping air movement that would otherwise allow sound and noise to travel. Conversely, flexible non-porous barriers can act as low-frequency, bass absorbers.

Sound diffuser materials or sound diffusing materials reduce the intensity of sound by scattering it over an expanded area, rather than eliminating the sound reflections as an absorber would. Traditional spatial diffusers, such as the polycylindrical (barrel) shapes also double as low frequency traps. Temporal sound diffusers, such as binary arrays and quadratics, scatter sound in a manner similar to diffraction of light, where the timing of reflections from an uneven surface of varying depths causes interference which spreads the sound.

Noise barrier materials are in general heavy, dense and solid to prevent sound penetration. A common material is drywall (gypsum, sheetrock). Thin materials with high sound blocking characteristics are lead foil and mass loaded vinyl. A sandwich of dissimilar materials such as five-eighths inch gypsum, one-eighth inch vinyl barrier, and a half-inch finish layer of drywall will block more effectively than an equivalent thickness of drywall alone. More energy is lost as sound must change its speed for each different material.

Sound isolator materials or sound isolating materials are in general resilient and prevent sound transmission through the structural steel or concrete of a building as well as its plumbing and air handling systems. Typical devices are resilient channel for drywall, isolation pads for floors, decoupling hangers for ceilings, and special adhesives for walls to avoid the hard connections of nails and screws that often provide a sound path through otherwise effective sound insulation materials.

Especially, the panel is configured to absorb and/or diffuse sound. Hence, in one or more embodiments, the acoustic panel is a sound absorbing and/or diffusing panel, even more especially a sound absorbing panel. Therefore, in an embodiment the sound reducing material comprises a sound absorbing material and/or a sound diffusing material.

For best properties with respect to glare, the angles of the tapering walls of the cavities may be chosen to reduce glare.

Note that the first cavity wall angle (•) and the second cavity wall angle (•) may be different for different elongated cavities. Assuming that the panel is arranged on a desk or on the floor, the lower cavities, especially comprising a light source, may, in an embodiment, have smaller first cavity wall angles (•), though especially larger than 0°, such as 0°<••65°; likewise, the higher cavities may have larger cavity angles, such as 15°•••65°, like 25°•••65°.

In an embodiment, for one or more cavities, especially for all of them, it holds that the first cavity wall has a first cavity wall angle (•) with a normal to the panel in the range of 0°<•65°, especially in the range of 15-65°, such as even more especially 25°•••65°, (and/or) wherein the second cavity wall has a second cavity wall angle (•) with a normal to the panel in the range of 25-90°, such as 25-80°, wherein the first cavity wall angle (•) is smaller than the second cavity wall angle (•). Especially, for one or more cavities, especially for all of them, it holds that the first cavity wall has a first cavity wall angle (•) in the range of 15°-35° and(/or) the second cavity wall has a second cavity wall angle (•) in the range of 45-65°, like 35-55°.

As in some embodiments part of the light may be reflected by a desk or items on a desk, it is further possible to improve well-being by means of (vertically arranged) bars directly in front of the light exit surfaces. Hence, in a further embodiment, the acoustic panel further comprises reflection-glare reducing bars, configured perpendicularly to the elongated cavities and configured to block and/or redirect direct lighting of an item in front of the acoustic panel with light rays from the light sources in a plane perpendicular to the acoustic panel and parallel to the reflection-glare reducing bars. Redirection of the direct light may for instance be achieved by using transparent prism foils (instead of oblique bars). These bars can be seen as a kind of louvers that block direct view of a bright source. In fact, the first cavity walls—when configured to hide the light exit surface—can thus also be considered louvers (likewise this can be the case when the second cavity wall is configured to hide the light exit surface). Hence, in an embodiment, the bars may be oblique, or in yet another embodiment, the bars may be transparent, but comprise light redirecting features. For instance, the bars may be configured to refract light of one or more light sources (emanating from the light exit surface(s) behind the respective bar(s)).

Hence, for best properties, the elongated cavities are tilted in such a way that a user cannot directly see light, but light of the light sources can be used as task lighting on for instance a desk. Light of the light sources that is reflected by the reflective cavities (i.e. reflective cavity walls), can be used as background lighting, and advantageously may contribute to an experience of daylight.

Further, for best properties it may be desirable not to perceive the elongated cavities as separate light sources, but rather to perceive the panel as a single light source. Hence, in an embodiment there are no substantially vertical panel elements between two adjacent cavity openings. In this way, dark "spaces" between the light emitting cavities may be reduced or even substantially eliminated. Further, it may be desirable that the distance between the elongated cavities is not too large. In a specific embodiment, the plurality of elongated cavities of the acoustic panel have a pitch in the range of 2-25 cm, especially in the range of 4-15 cm. In this way, also the light sources in the elongated cavities have such a pitch.

As will be clear to a person skilled in the art, during use of the acoustic panel, the acoustic panel will be arranged in such a way that the first cavity walls hide the light exit surfaces of the light sources when the acoustic panel is viewed along a normal to the support frame. In yet another embodiment, during use of the acoustic panel, the acoustic panel will be arranged in such a way that the second cavity walls hide the light exit surfaces of the light sources when the acoustic panel is viewed along a normal to the support frame. In an embodiment, the elongated bars overlap each other, like tiles on a roof.

The phrase "viewed along a normal" especially relates to an observer who is at a distance from the panel of 20 times the height of the panel. If such an observer, when viewing along the normal, does not observe direct light (from the light exit surfaces) from any of the cavities, then the first cavity wall(s) (or the second cavity wall(s)) block the respective light exit surface(s) well. A stricter requirement can be made when the distance between the observer and the panel is set at 10 times the height of the panel. Nevertheless, this may still allow lower cavities to have a smaller cavity angle than upper cavities. In other words, the lower elongated cavities may have larger cavity opening angles.

The term "elongated cavity" relates to a cavity which has a cavity length that is larger than the cavity height. Especially, the length (width) (cw) of the cavity opening is substantially smaller than the length (L) of the elongated cavity. In an embodiment, cw/L<1, especially <0.5, even more especially <0.1. For instance, the elongated cavity may be a trench having a length of 2 m, and a cavity opening between the first cavity wall and the second cavity wall may be selected in the range of 5-20 cm, which leads to a ratio of cw/L in the range of 0.025-0.1.

The elongated cavities are, as indicated above, especially arranged in a parallel manner. Hence, this especially implies that elongated channel axes are arranged in parallel. The elongated cavities may also be seen as elongated grooves or elongated, especially tapered, trenches. The term "parallel" may also include arrangements with small deviations, like small angles relative to each other, such as in the range of 0-10°, especially 0-5°, such as 0-2°, like 0-1°. Hence, the elongated channel axes, respectively, or the first cavity walls, respectively, and the second cavity walls, respectively, may be at such angles relative to each other.

The elongated bars may be hollow or solid. The elongated bars may comprise sound reducing material, or are entirely made of sound reducing material. The cavity walls of the elongated bars may be coated with a reflective material or a reflector may be applied to such walls.

As the same element is used for both reflection of light and reduction of sound, a reduction in size, thickness and/or width and costs compared to the conventional solutions with stacked optical and acoustic elements is attained. In principle, any light reflective, sound reducing material can be applied to form the reflector, for example cotton wadding wound around and carried by a rigid frame. However, especially the sound reducing material should have properties typical of reflectors, i.e. highly reflective to light, sufficient mechanical strength, heat and/or flame resistant etc. In this respect, heat resistant means that the material as such should be able to withstand a continuous service temperature of at least 120° C. during 30 days, and flame resistant, in this respect, means that the material as such does not propagate a flame. In particular, the sound reducing material especially is sufficiently rigid for example not to deform due to its own weight, and sufficiently rigid to be able to carry (small) light sources, and maintain its preformed optical shape throughout its lifetime under specified thermal and environmental conditions.

Especially, the reflector is diffusely reflective or has at least a highly diffusive reflection component, for example in that the reflector is more than 70% or 80%, or especially 95% or more, diffusely reflective and/or less than 30% or 20% or 5% or even less, specularly reflective. Diffuse reflectors allow the use of porous, open, or rough structures, which are better suited for the absorption of sound than closed, smooth surfaces, which are better suited for use as specularly reflective surfaces. Furthermore, diffusely reflective surfaces reduce the risk of glare, which is of particular importance in office lighting and for working with computers, and diffusely reflective surfaces are particularly suitable in environments where accurate beams, such as required for spotlighting, are somewhat less critical. Yet, if specularly reflective surfaces are desired, the acoustically absorbing material can be coated with a reflective metal coating, for example an aluminum coating. For a semi-specularly reflective reflector, a coating of sanitized, white paint on the sound-absorbing material is appropriate. Hence, in an embodiment the reflective material comprises a diffusely reflective material.

Known materials that have at least one of the abovementioned properties are Basotect® from BASF, a flexible, lightweight, sound-absorbing, open-cell foam made from melamine resin, which is a thermoset/thermo-formable polymer with a reflectivity of about more than 85% depending on the applied coating, and GORE™ DRP® reflector material from Gore, a micro porous structure made from durable, non-yellowing polymer PTFE (poly-tetra-fluoro-ethylene) with a reflectivity of about more than 99%. Especially, the cavity wall(s) is(are) made of (diffusely) reflecting material which typically has a reflectivity of 80% to 99.5%.

Hence, in an embodiment the reflective material is made of a sound reducing material.

Especially, the light source comprises a light-emitting surface being arranged at the cavity back end, such as a narrow end of the tapered reflector (i.e. at the tapering end), said light-emitting surface being at least partially directed to the cavity opening, and especially having a dimension substantially equal to a dimension of the narrow end of the tapered reflector, and being used for emitting substantially diffuse light towards a wide end of the tapered reflector. The light source may, in an embodiment, be close to the narrow end, thus counteracting the possibility of an optical gap through which light may leak, and additionally enabling a lower peak value of the light intensity while the same amount of light may still be issued from the illumination system. Especially, the one or more exit surfaces of the light sources are configured towards the cavity openings (not towards the cavity back end, such as for example the tapering end when tapering elongated cavities are applied).

The light sources may optionally be arranged in reflectors at the cavity back ends, such as the tapering end(s).

A further effect of the illumination system according to the invention is that the solution for generating an illumination system complying with the glare requirements is relatively cost-effective. Often, in known illumination systems, prismatic plates/sheets are used to limit the glare value. Such prismatic sheets are relatively expensive and the application of prismatic sheets in the known illumination systems is relatively expensive. Also the placement of louvers for limiting the glare produced by, for example, fluorescent light sources, is relatively time-consuming and thus relatively expensive, though such use is not excluded. The tapered reflectors may be produced relatively cost-effectively, for example, from highly diffusely reflective foam and are shaped using, for example, thermo-forming processes.

Optionally, downstream of the light source(s), but close to the cavity back end, such as a tapering end, such as even in physical contact with the light source, a (further) scattering element may be arranged. This may be in addition to or instead of the above-described optional reflective-glare reducing bars (see also above). For instance, a translucent window may be applied.

The terms "upstream" and "downstream" relate to an arrangement of items or features relative to the propagation of the light from a light generating means (here especially the light source), wherein relative to a first position within a beam of light from the light generating means, a second position in the beam of light closer to the light generating means is "upstream", and a third position within the beam of light further away from the light generating means is "downstream".

The light source can be any light source, but is (thus) especially a light source that is able to substantially emit in the visible. Hence, in an embodiment the light source comprises a white light emitting device. The term light source may especially relate to a LED (light emitting diode). In a specific embodiment, the light source comprises a solid state LED light source (such as a LED or laser diode).

The term "light source" may also relate to a plurality of light sources, such as 2-100 (solid state) LED light sources. Especially, the light sources in the cavities are configured to provide an elongated beam of light, especially over substantially the entire length of the cavity. Hence, in use, the bars are alternated with elongated beams of light emanating from the cavities. The light source(s) within the cavities have a light exit surface. Hence, in an embodiment, the light sources comprise light sources with a plurality of light exit surfaces and/or in another embodiment, one or more elongated cavities comprise a plurality of light sources. In an embodiment, the light source is an elongated light source, comprising a plurality of light exit surfaces. For instance, this can be an elongated waveguide, with light outcoupling structures. As indicated above, especially the light sources comprise light emitting diodes (LEDs).

In case a cavity comprises a plurality of light exit surfaces, the pitch between the light exit surfaces may especially be in the range of 2-25 cm, especially in the range of 4-15 cm.

The frame may be an open fame, like bars (vertically arranged during use), or an open frame including horizontal bars arranged between vertical bars, or any other type of frame. In an embodiment, the panel might be curved, with a curvature in a plane parallel to the elongated bars and comprising a normal to the support frame. The support frame may, in an embodiment, be the backbone that holds the bars, and optionally also the light sources. The bars, and optionally the light sources, may be connected to the frame with connectors known in the art. In an embodiment, the frame is closed, i.e. it is a plate. Additionally or alternatively, when the panel comprises the frame, the frame may comprise sound reducing or sound blocking material.

The frame may optionally also have a heat sink function for the light source(s). Optionally, the frame also includes electronic devices like one or more control units configured to control the individual light sources and a transformer for transforming power to suitable electrical power for the light source(s).

The elongated bars may be configured on one side of the frame, or bars may be present on both sides of the frame. When bars are present on both sides, a single bar extending to both sides of the frame may be applied, or individual bars on both sides may be applied. Hence, in an embodiment, the acoustic panel comprises said elongated cavities on both sides of the frame, and wherein the light sources are configured to provide light emanating from both sides of the acoustic panel.

In an embodiment, the acoustic panel may also be frameless. In a specific embodiment, the acoustic frame comprises a panel of acoustic material, with the elongated cavities provided therein, and the light sources arranged at the back ends of the cavities.

Further, the acoustic panel may consist of one or more parts. Thus, a single panel may be one integral unit or may consist of two or more panel elements. These panel elements may be arranged next to each other, such as in edge-to-edge physical contact, to allow the elongated cavities of adjacent panels to form a single elongated cavity. Hence, in an embodiment, the acoustic panel comprises a panel element of sound reducing material comprising said plurality of elongated cavities or elongated cavity sections. Especially, in an embodiment the acoustic panel comprises a plurality of panel elements of sound reducing material, each panel element comprising elongated cavity sections. Adjacent panel elements may be configured to provide the acoustic panel.

The acoustic panel may have any dimension, but especially has a height selected in the range of 140-190 cm, especially 150-185 cm, or selected in the range of 70-125 cm, especially 80-120 cm. The former height may especially be suitable for room dividers (office dividers); the latter height may especially be suitable for desk dividers.

The term "substantially" herein, such as in "substantially all emission" or in "substantially consists", will be understood by the person skilled in the art. The term "substantially" may also include embodiments with "entirely", "completely", "all", etc. Hence, in embodiments the adjective substantially may also be removed. Where applicable, the term "substantially" may also relate to 90% or higher, such as 95% or higher, especially 99% or higher, even more especially 99.5% or higher, including 100%. The term "comprise" includes also embodiments wherein the term "comprises" means "consists of".

Furthermore, the terms first, second, third and the like in the description and in the claims, are used for distinguishing between similar elements and not necessarily for describing a sequential or chronological order. It is to be understood that the terms so used are interchangeable under appropriate circumstances and that the embodiments of the invention described herein are capable of operation in sequences other than those described or illustrated herein.

The devices herein are amongst others described during operation. As will be clear to the person skilled in the art, the invention is not limited to methods of operation or devices in operation.

It should be noted that the above-mentioned embodiments illustrate rather than limit the invention, and that those skilled in the art will be able to design many alternative embodiments without departing from the scope of the appended claims. In the claims, any reference signs placed between parentheses shall not be construed as limiting the claim. Use of the verb "to comprise" and its conjugations does not exclude the presence of elements or steps other than those stated in a claim. The article "a" or "an" preceding an element does not exclude the presence of a plurality of such elements. The invention may be implemented by means of hardware comprising several distinct elements, and by means of a suitably programmed computer. In the device claim enumerating several means, several of these means may be embodied by one and the same item of hardware. The mere fact that certain measures are recited in mutually different dependent claims does not indicate that a combination of these measures cannot be used to advantage.

The invention further applies to a device comprising one or more of the characterizing features described in the description and/or shown in the attached drawings.

The various aspects discussed in this patent can be combined in order to provide additional advantages. Furthermore, some of the features can form the basis for one or more divisional applications.

BRIEF DESCRIPTION OF THE DRAWINGS

Embodiments of the invention will now be described, by way of example only, with reference to the accompanying schematic drawings in which corresponding reference symbols indicate corresponding parts, and in which.

The drawings are not necessarily to scale.

DETAILED DESCRIPTION OF THE EMBODIMENTS

FIGS. 1*a*-1*j* schematically depict some embodiments and variants of the invention.

Figure 1A:
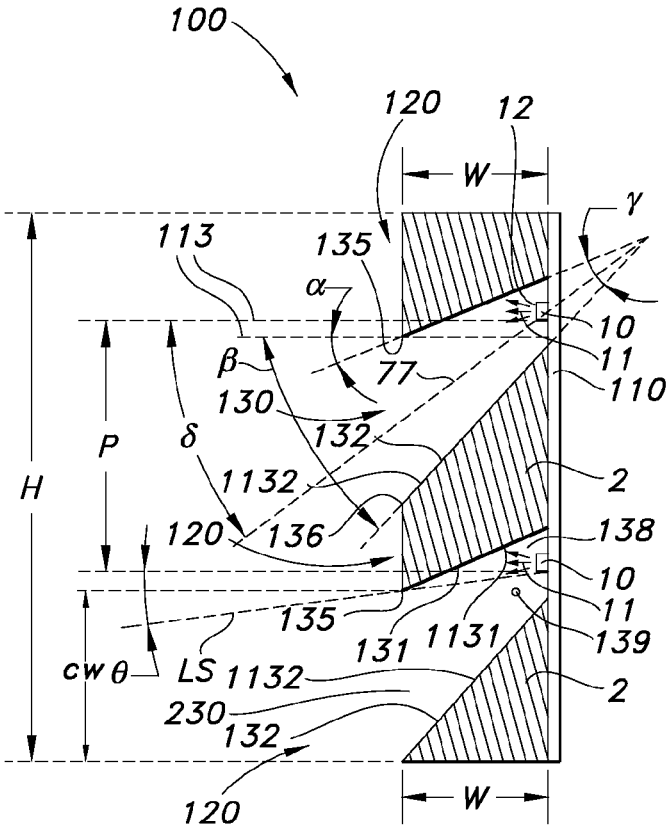
FIGS. 1*a*-1*j* schematically depict some embodiments and variants of the invention.

FIG. 1*a* schematically depicts an embodiment of the acoustic panel 100 in side view. The acoustic panel 100 comprises a support frame 110 with parallel-arranged elongated bars 120 connected to said support frame 110. The elongated bars 120 comprise sound reducing material, indicated with reference numeral 2.

As can be seen from the figures, the elongated bars 120 are configured to provide elongated cavities 130 (also indicated as cavities 130) between adjacent elongated bars 120. As a result, the acoustic panel 100 comprises a plurality of said elongated cavities 130.

Each cavity 130 has a first cavity wall 131 and a second cavity wall 132 tapering in the direction of the support frame 110 and defining a cavity opening angle • having e.g. a value in the range of 35-75°.

The cavity 130 has a cavity axis (or plane in fact) 77, which can be considered a bisector (plane). This bisector (plane) has an angle • with a normal 113 to the frame 110 in the range of e.g. 15-80°. During use of the panel 100, this bisector (plane) may point towards the earth's surface, when viewing this plane from the acoustic panel 100 (however, other embodiments are also possible, see also below). The first cavity walls 131 hide the light exit surfaces 12 of the light sources 10 when the acoustic panel 100 is viewed along a normal to the support frame 100.

The first cavity wall 131 and the second cavity wall 132 may, in an embodiment, comprise a light reflective material. This may be a separate reflector, such as a coating, or the acoustic material 2 may also have light reflective properties. The reflectors are indicated with reference numerals 1131 (first cavity wall reflector) and 1132 (second cavity wall reflector), respectively.

Each elongated cavity 130 accommodates, at a back end 138 (here a tapering end) of the cavity 130, a light source 10 having a light exit surface 12. This light source 10 may be connected to the frame. In general, a plurality of light sources, or at least a plurality of light exit surfaces in each elongated cavity, are applied. The cavity back end is one end of the elongated cavity, and the cavity opening is the other end of the cavity 130. The fact that in FIG. 1*a* each cavity 130 accommodates a light source 10 (or a plurality of light sources) is an example of one of the embodiments.

Here, each first cavity wall 131 has a first cavity wall angle • with a normal to the acoustic panel (or in this case also a normal to the support frame 110), said angle • especially being in the range of 15-65°. Further, each second cavity wall 132 has a second cavity wall angle with a normal to the support frame 110, said angle • especially being in the range of 25-80°. The first cavity wall angle • is smaller than the second cavity wall angle •. In this way, the asymmetrically tapering cavities are obtained.

Reference p indicates the pitch between the plurality of elongated cavities 130, and thereby also the pitch between the light sources in the respective elongated cavities 130.

Reference LS indicates the first line of sight, when the panel 100 is in an upright position perpendicular to the earth's surface, and an observer in front of the panel 100 would change the observation position downwards from a position where the exit surface 12 of the light source 10 in a specific cavity 130 is hidden by the elongated bar over the light source to the first position where the light exit surface of that light source is visible. Alternatively, this line of sight can be defined as a line interconnecting the lowest part of the light exit surface of a specific light source 10 and the end tip (extremity or edge) of the first cavity wall, indicated with reference numeral 135, of the bar over said light source. The angle of this LS line with a normal to the surface is indicated with reference •. The value of this angle • is especially in the range of 15-65°, more especially in the range of 15-35°. As, in the present case, we are dealing with elongated cavities, the line of sight may also relate to a plane of sight.

Reference 139 indicates an axis or elongation axis or elongated axis of the elongated cavity 130. Note that the elongation axes 130 of elongated cavities on a single acoustic panel 100 will preferably substantially be parallel arranged. Further, they will substantially be in a single plane. The normal 113 is configured so as to be perpendicular to such a plane (of elongation axes 130).

Assuming the height H to be 150 cm, an observer at a distance of 10*150 cm from the acoustic panel 100, viewing along the normal 113, will not perceive direct lighting. Thus, the first cavity walls 131 (or in other embodiments the second cavity walls 132, see below) hide the light exit surfaces 12 from such an observer at such a distance. Thus, behind the first cavity wall end tip(s) 135 (or, in other embodiments, behind end tip 136 of the second cavity wall 132, see below) light exit surfaces 12 are hidden from such an observer.

Reference W indicates the width (or depth) of the elongated cavity 130. This width may for instance be in the range of 0.5-20 cm, especially 1-20 cm, such as 1-10 cm, like at least 2 cm.

Figure 1B:
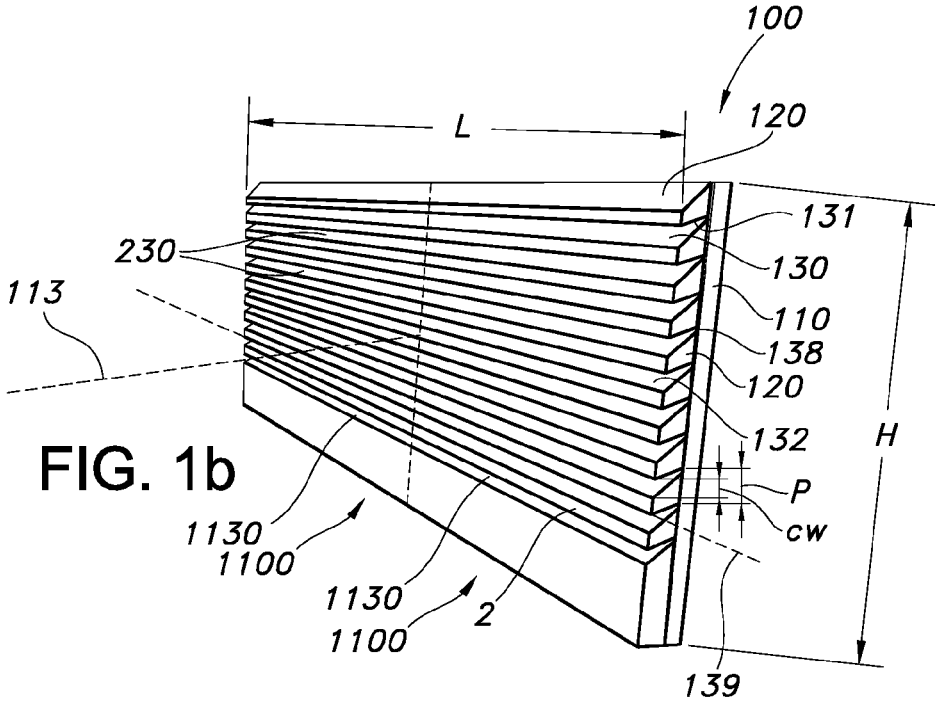

FIG. 1*b* schematically depicts the tile-wise arrangement of the elongated bars. FIG. 1*b* schematically depicts a perspective view of the acoustic panel 100.

The height of the panel is indicated by the letter H; the length of the panel is indicated by the letter L. Note that the cavities 130 and the elongated bars all substantially have the length L. The elongated cavities 130 have elongation axes 139. As will be clear to a person skilled in the art, these elongation axes 139 are in general arranged in parallel. The elongation axes 130 of a plurality of elongated cavities are in general in a single plane. The normal 113, indicated hereinabove to be a normal to the acoustic panel 100, will thus also be configured so as to be perpendicular to such a plane containing a plurality of elongation axes 139.

In general, the edges of the cavities will not be closed, as can be seen in FIG. 1*b*, as this may have effects on the light distribution.

The sound reducing material, such as a sound absorbing material, can be any material having such properties. Further, especially such material may be coated with a material that reflects light well, without blocking the propagation of sound through the coating. Such coatings are well known e.g. in the field of acoustic ceiling tiles. In case of microperforated plastic panels, the panels may be simply painted white (care being taken not to fill the holes with paint) or the panel material may be white plastic.

Optionally, the acoustic panel comprises a plurality of subunits. This variant is also schematically depicted in FIG. 1*b*. Here, the acoustic panel 100 comprises a plurality (here 2) of panel elements 1100 comprising sound reducing material, and each panel element 1100 comprising elongated cavity sections 1130. The panel elements 1100 can be arranged with respect to each other, or even connected to each other, to allow adjacent elongated cavity sections 1130 on different panel elements 1100 to form the elongated cavities 130 across the plurality of panel elements 1100.

Referring to FIGS. 1*a*-1*b* (and also the other embodiments described herein), each elongated cavity 130 is thus formed by first face 131 and second face 132, and has a cavity back end 138, wherein the light source(s) 10 may be arranged, and a cavity opening 230, through which light source light, indicated with reference numeral 11, may escape from the cavity. In this way, from one or more elongated cavities 130 light may emanate (during use of the acoustic panel as lighting unit). The cavity opening 230 has a height, which is indicated with reference cw. This will in general be the distance between the first cavity wall end tip 135 of the first cavity wall 131 and the second cavity wall end tip 136 of the second cavity wall 132. Especially these end tips define the cavity opening 230. The first cavity wall end tip is a kind of horizon beyond (here above) which an observer may not be able to see directly the light exit surface of the respective light source; the second cavity wall end tip is a kind of horizon beyond (here below) which an observer may not be able to see directly the light exit surface of the respective light source. The cavity opening 130 may have a height or width cw (cavity width) in the range of e.g. 2-10 cm. The length L of the elongated cavity may for instance be in the range of 1-5 m.

Figure 1C:
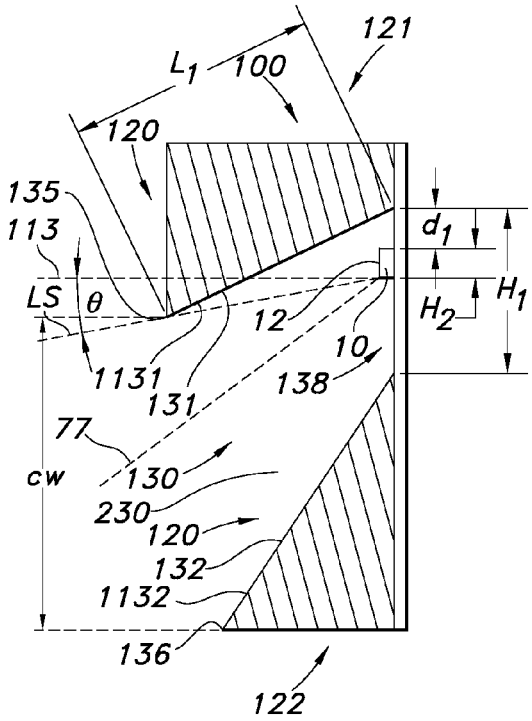
Figure 1D:
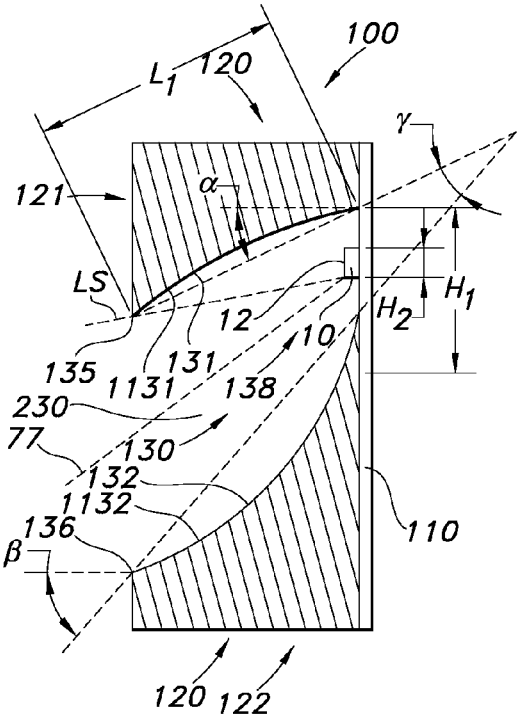

FIGS. 1*c* and 1*d* schematically depict some alternative embodiments, wherein in the former the cavity walls 131 and 132 are straight, and in the latter these walls are curved. The length of the first cavity wall 131 is indicated with reference L2. In case a curved first cavity wall 131 is applied, the length is defined as the length of the straight line between the onset and the end tip 135 of the first cavity wall; likewise in case a curved second cavity wall 132 is applied, the length is defined as the length of the straight line between the onset and the end tip 136 of the second cavity wall. Here, the first cavity wall is convex-curved. Concave-curved first cavity walls may not be applied. The angles of the upper and second cavity walls 131,132 are also taken as the angles with the normal to the frame of straight lines between the respective onsets and the end tip 135 of the first cavity wall and the end tip of the second cavity wall 132. The end tip (or edge) of the second cavity wall 132 is indicated with reference numeral 136.

The light source has an exit surface 12, which has a height H2. The light exit surface 12 may have a non-zero distance d1 to the first cavity wall 131, though in general this distance d1 will be kept small. The length of d1+H2 is especially substantially smaller than the length L1 of the first cavity wall. For instance, L1/(d1+H2)>2, especially >5, like >10. Especially, alternatively or additionally, W/(d1+H2)>2 (see also FIG. 1*a*.)

FIGS. 1*c* and 1*d* schematically depict only two bars 120, which are here also indicated as upper bar 121 and lower bar 122. Note however that a lower bar for one cavity, may be an upper bar for another cavity (see FIGS. 1*a*-1*b* and 1*e*). Hence, these elongated bars 120, having sound reducing properties, are further simply indicated as (elongated) bars 120.

Figure 1E:
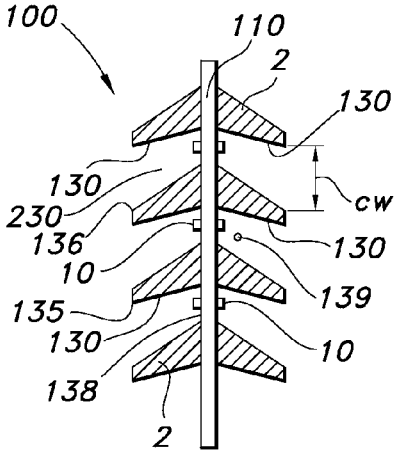

FIG. 1*e* schematically depicts an embodiment of the acoustic panel having elongated bars 120 with acoustic material 2 on both sides of the frame. The bars 120, which are at the same height on both sides of the frame 110, may optionally be a single elongated bar 120. Likewise, optionally, the light sources 10 for providing light emanating from both sides of the acoustic panel 100 may be light sources that are able to provide light in opposite directions, like fluorescent tubes. However, in a specific embodiment, light sources, such as LEDs, are applied, on both sides of the frame 110, and configured to provide light through one cavity in one direction.

Note that in FIG. 1*a* for instance, there are vertical elements between adjacent elongated cavities 130, whereas in FIG. 1*e* there are substantially no vertical elements (or facets) between adjacent elongated cavities 130. Vertical elements are elements which are situated on the cavity-opening side of the panel, and which are parallel to a plane through the acoustic panel 100. In FIGS. 1*a* and 1*e*, the plane through the acoustic panel is configured so as to be perpendicular to the plane of the drawing; in FIG. 1*f* such a plane is in the plane of the drawing.

Figure 1F:
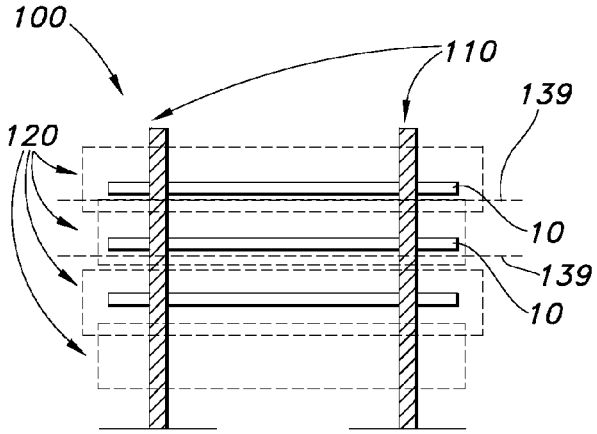

FIG. 1*f* schematically depicts an embodiment of the acoustic panel 100, seen from the backside (assuming that there are no bars 120 at the back (anymore)). Here, a frame of only two piles is shown, to which the elongated bars 120 are connected. Elongated light sources 10 may also be connected to those two piles. Note that all other types of frames may be possible.

Figure 1G:
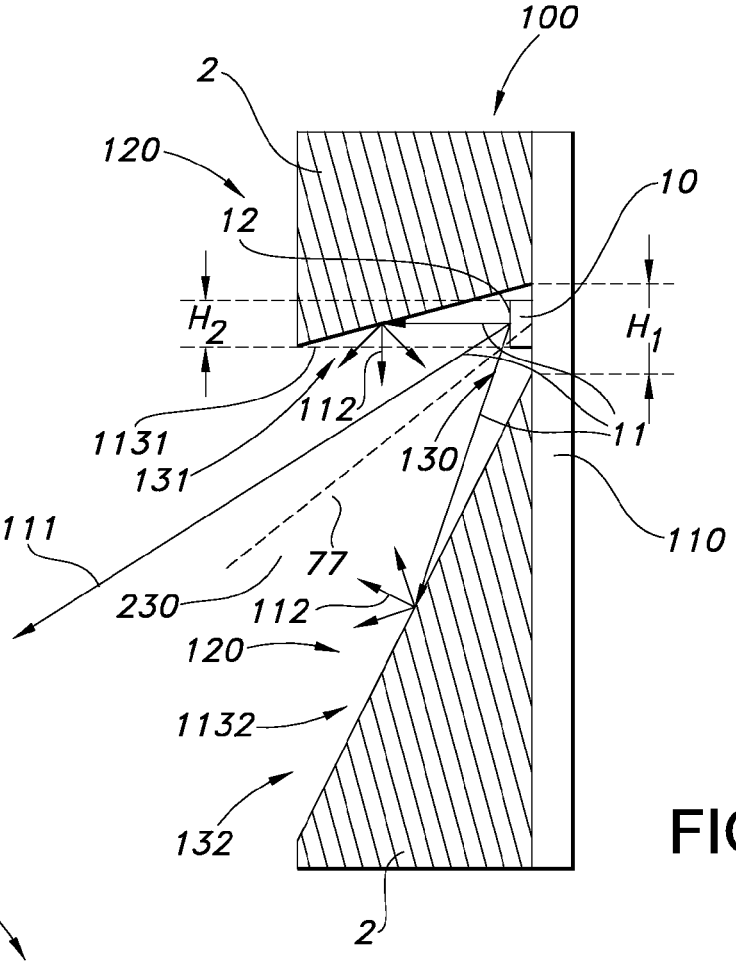
Figure 1H:
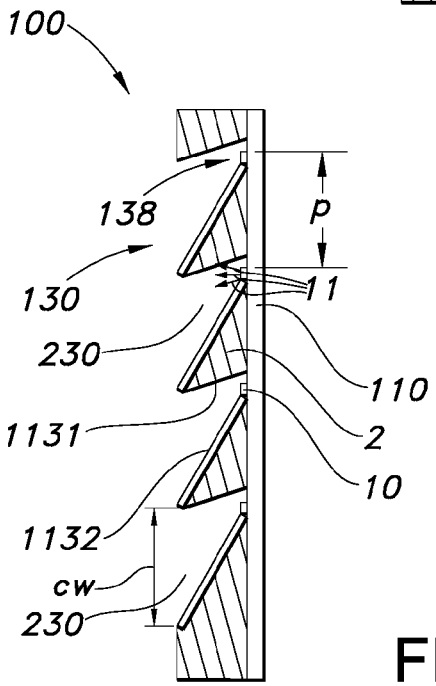

FIGS. 1*g* and 1*h* schematically depict some variants, which may also apply to the above-depicted embodiments and variants. The sawtooth variant in FIG. 1*h* allows a smaller pitch as compared to a panel with high elongated bars 120, as in FIG. 1*g*. FIG. 1*h* also indicates the height of the cavity back end 138, which height is indicated with reference H1. Especially, H1•H2 (see also above). Reference 111 indicates direct light; reference 112 indicates light reflected by the reflective walls. Hence, the light source light 11 may lead to direct light 111 and indirect light 112.

FIG. 1*h* (and also 1*e*) shows a preferred embodiment of the invention, in which the slits or funnels form a continuous area, (substantially) without vertical facets of the acoustic absorbing material in between the funnels or slits (as is shown in FIGS. 1*a*-1*d* and 1*g*). In this embodiment, the whole area is diffusely lit, substantially without dark regions in between the funnels or slits. This avoids strong contrasts in luminance and hence avoids eye fatigue.

Figure 1I:
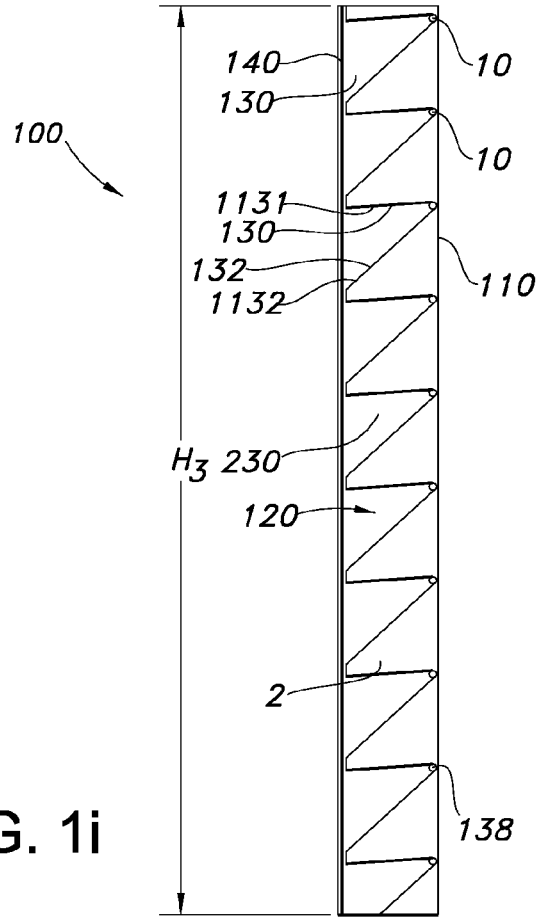
Figure 1J:
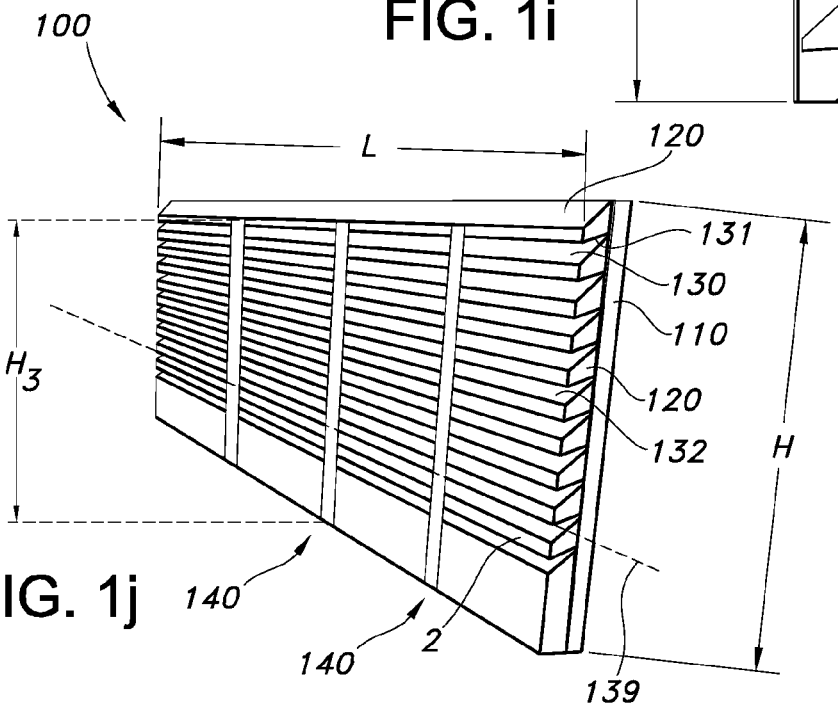

FIGS. 1*i* and 1*j* schematically depict embodiments where the acoustic panel 100 further comprises reflection-glare reducing bars 140, configured perpendicularly to the elongated cavities 130 and configured to block direct lighting of an item in front of the acoustic panel with light rays from the light sources 10 in a plane perpendicular to the acoustic panel 100 and parallel to the reflection-glare reducing bars 140. FIG. 1*i* is a side view and FIG. 1*j* is a perspective view. The height of these reflection-glare reducing bars 140 is indicated with reference H3. Note that in these embodiments the height H3 of the reflection-glare reducing bars 140 is about the same as the height H of the panel 100. These bars may only be applied when the light exit surfaces 12 are discrete surfaces, such as in the case of LEDs. In that case, the width of the bars may be in the range of 1-20 times the width of the discrete surfaces of the light exit surfaces.

Figure 2A:
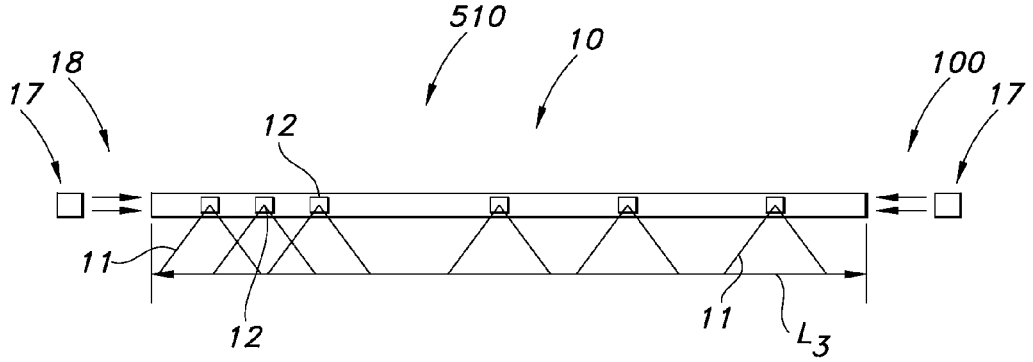
FIGS. 2*a*-2*c* schematically depict some embodiments of the light source(s) for the acoustic panel.
Figure 2B:
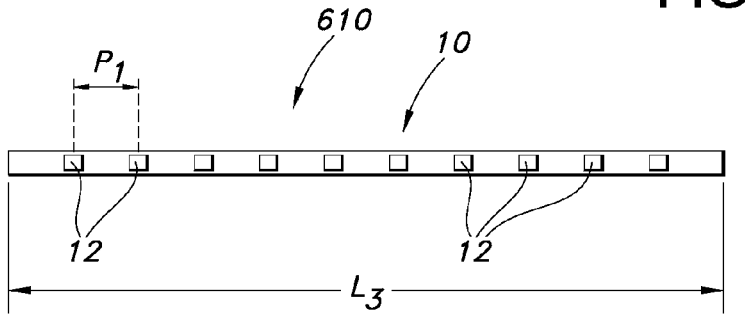
Figure 2C:
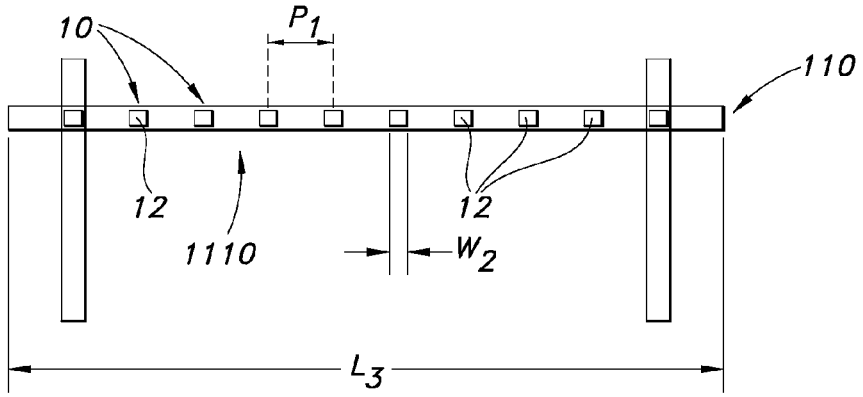

FIGS. 2*a*-2*c* schematically depict some embodiments of light sources that are able to provide an elongated beam of light emanating from a cavity. FIG. 2*a* schematically depicts an elongated light source 10, such as a fiber or waveguide, with light outcoupling structures which provide the light exit surfaces 12. Hence, an elongated light source is depicted, which is indicated with reference numeral 510. The length of the elongated light source 510 is indicated with L3, and may be in the range of 80-100%, especially 90-100%, such as even 95-100% of the length L of the panel 100. FIG. 2*b* schematically depicts a bar with a plurality of light sources. The light source bar is indicated with reference numeral 610. For instance, this may be a unit with a plurality of LEDs. The pitch of the light exit surfaces 12 is indicated with reference P1, and is especially small, such as in the range of up to about 20 cm, especially in the range of up to 10 cm.

Alternatively or additionally, the pitch of the light exit surfaces is defined to be smaller than the width (depth) of the cavity 130. Hence, in an embodiment, W>P1, such as W/P1>1.5, like W/P1>2.

However, as indicated above, the elongated cavities may also comprise a single elongated light source, such as a fluorescent tube.

FIG. 2*c* schematically depicts an embodiment, wherein (simply) a plurality of light sources, such as LEDs, are provided, such as on a support 1110, which support may be part of the frame 110 (or may be connected to an existing frame).

Figure 3A:
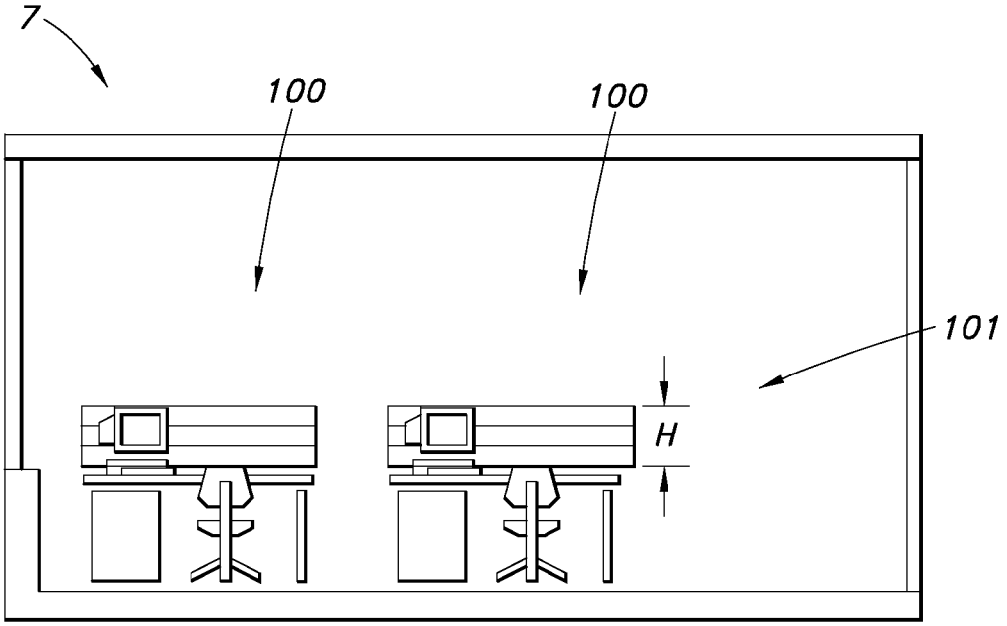
FIGS. 3*a*-3*b* schematically depict some applications of the acoustic panel.
Figure 3B:
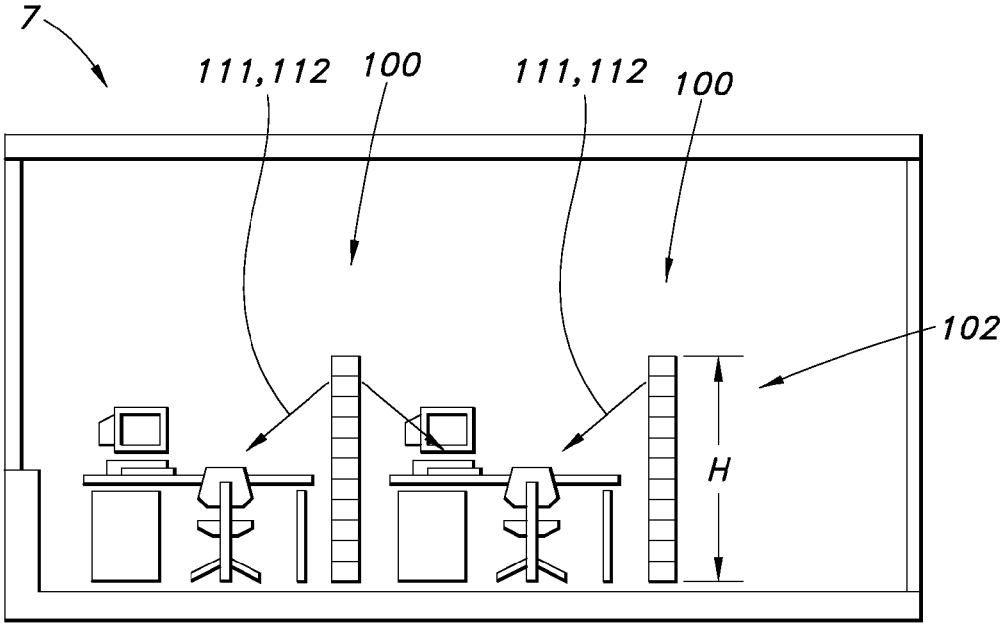

FIGS. 3*a* and 3*b* schematically depict applications of the acoustic panel, as desk divider 101 and room divider 102, respectively. Reference numeral 7 indicates the working area. Reference numeral 111 indicates direct light; reference numeral 112 indicates light reflected by the reflective walls. These types of panels 100 are suitable for use in sectors in need of improved room acoustics and task light and/or daylight, e.g. open plan offices, restaurants, libraries, patient rooms. However, the acoustic panel 100 may also be used in applications other than those described and or depicted herein.

Figure 4A:
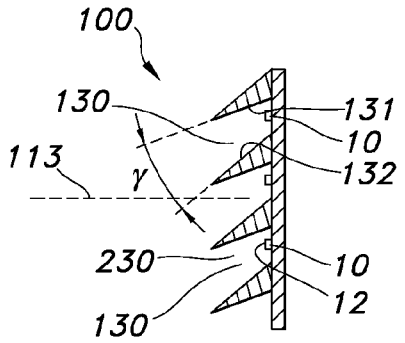
FIGS. 4*a*-4*e* schematically depict some further embodiments of the acoustic panel.
Figure 4B:
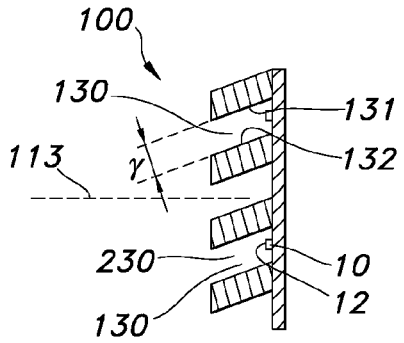
Figure 4C:
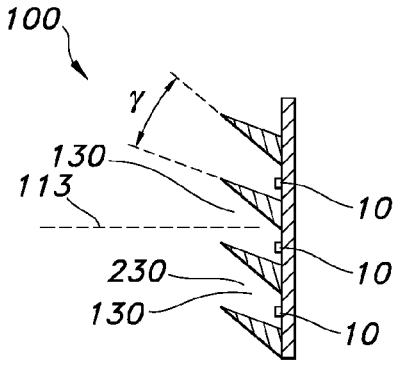
Figure 4D:
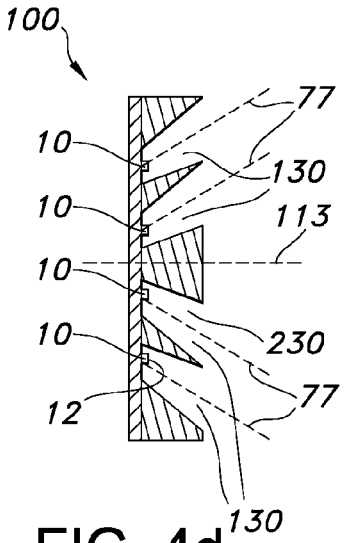
Figure 4E:
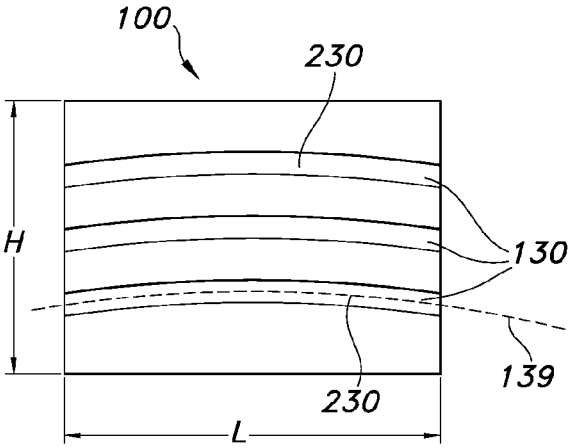

FIG. 4*a* schematically depicts an embodiment of the acoustic panel 100 similar to those schematically depicted in FIGS. 1*a*, 1*b* and 1*e*. By way of example, not each elongated cavity 130 comprises light sources 10. FIG. 4*b* schematically depicts an embodiment wherein the first cavity wall 131 and the second cavity wall 132 are arranged in parallel, but both at non-zero angles with respect to the normal 113. Hence, also in this embodiment the light source(s) 10, or more especially their light exit surfaces 12, are hidden by the first cavity wall 131 (cf examples 4*a*-4*b*) or the second cavity wall 132, which are upper cavity walls. FIG. 4*c* is essentially the same as FIG. 4*a*, with the exception that the cavities point in another direction. For instance the embodiment of FIG. 4*c* might be obtained when the acoustic panel 100 of FIG. 4*a* is arranged upside down. Note that this may of course also apply to the other embodiments schematically depicted herein. FIG. 4*d* schematically depicts an embodiment wherein the elongated cavities have cavity axes (or planes in fact) 77 (which can be considered bisector(s) (planes); see also above), which make different angles with the normal 113. Or in other words, the cavity axes or planes 77 have mutual angles which are non zero. FIG. 4*e* schematically depicts an embodiment wherein the elongated cavities 130 are curved. Here, all elongated cavities are curved, but in an embodiment only a subset may be curved. Thus, the elongation axes 139 in this embodiment are curved. Note that in the schematically depicted embodiment, the elongated cavities 130 are still parallel arranged.

An acoustic panel was built and used as desk divider. Substantially homogenous lighting of the desk was obtained, without direct light being visible by an observer sitting behind the desk.

Further, light simulations of acoustic panels were performed, with and without bars. From those simulations, it can be concluded that good light distributions can be achieved behind such acoustic panels.

The invention claimed is:

1. An acoustic panel comprising:

one or more elongated cavities, wherein each cavity of the one or more elongated cavities has a first cavity wall, a second cavity wall, a cavity opening between the first cavity wall and the second cavity wall, and a cavity back end, wherein the cavity back end opposes said opening, the cavity back end is disposed farther from said opening than said first cavity wall and the cavity back end is disposed farther from said opening than said second cavity wall, wherein at least one given cavity of the one or more elongated cavities accommodates a light source having a light exit surface, wherein the light source is configured to provide light source light emanating from the cavity opening of the at least one given cavity, wherein the first cavity wall or the second cavity wall hides the light exit surface of the light source when the acoustic panel is viewed along a normal to the acoustic panel, and wherein the acoustic panel further comprises sound reducing material; and a support frame which holds the light source at the cavity back end of the at least one given cavity, wherein the first cavity wall and the second cavity wall of the at least one given cavity taper to the cavity back end of the at least one given cavity and define a cavity opening angle ($\gamma$) having a value in the range of $0° < \gamma < 90°$.

2. The acoustic panel according to claim 1, wherein the first cavity wall and the second cavity wall of the at least one given cavity comprise a diffusely reflective material.

3. The acoustic panel according to claim 2, wherein the one or more elongated cavities form a continuous area, substantially without vertical facets of the sound reducing material in between the one or more elongated cavities.

4. The acoustic panel according to claim 3, wherein $35° \leq \gamma \leq 75°$.

5. The acoustic panel according to claim 4, wherein the one or more elongated cavities are arranged in parallel.

6. The acoustic panel according to claim 5, wherein parallel-arranged elongated bars are connected to the support frame, said elongated bars comprising the sound reducing material, said elongated bars further being configured to provide at least one of the one or more elongated cavities between two adjacent elongated bars of the parallel-arranged elongated bars, wherein the one or more elongated cavities is a plurality of elongated cavities.

7. The acoustic panel according to claim 6, wherein the first cavity wall of the at least one given cavity has a first cavity wall angle ($\alpha$) with the normal to the acoustic panel in the range of 15-65°, the second cavity wall has a second cavity wall angle ($\beta$) with the normal to the acoustic panel in the range of 25-80°, wherein the first cavity wall angle ($\alpha$) is smaller than the second cavity wall angle ($\beta$).

8. The acoustic panel according to claim 7, wherein the first cavity wall of the at least one given cavity has a first cavity wall angle ($\alpha$) in the range of 15-35° and wherein the second cavity wall of the at least one given cavity has a second cavity wall angle ($\beta$) in the range of 35-55°.

9. The acoustic panel according to claim 8, wherein the at least one given cavity is a plurality of given cavities that have a pitch (p) in the range of 2-25 cm.

10. The acoustic panel according to claim 9, wherein one or more of the given cavities comprise a plurality of light sources.

11. The acoustic panel according to claim 10, wherein the acoustic panel comprises a panel element of sound reducing material comprising said one or more of the given cavities or elongated cavity sections.

12. The acoustic panel according to claim 11, further comprising reflection-glare reducing bars, configured perpendicularly to the plurality of elongated cavities and configured to block and/or redirect direct lighting of an item in front of the acoustic panel with light rays from the plurality of light sources in a plane perpendicular to the acoustic panel and parallel to the reflection-glare reducing bars.

13. The acoustic panel according to claim 12, comprising said one or more elongated cavities on two opposing sides of the frame, and wherein light emanates from the two opposing sides of the acoustic panel.

14. The acoustic panel according to claim 1, wherein the acoustic panel is configured as an office divider wall configured to delineate work spaces.

15. A lighting system for a work space, the lighting system comprising:

a desk for being disposed on a floor; and a divider wall positioned to block a view of said desk from a person seated and/or standing on said floor and outside of said work space in which the lighting system is disposed, wherein the divider wall comprises at least one acoustic panel including:

one or more elongated cavities, wherein each cavity of the one or more elongated cavities has a first cavity wall, a second cavity wall, a cavity opening between the first cavity wall and the second cavity wall, and a cavity back end, wherein the cavity back end opposes said opening, the cavity back end is disposed farther from said opening than said first cavity wall and the cavity back end is disposed farther from said opening than said second cavity wall, wherein at least one given cavity of the one or more elongated cavities accommodates a light source having a light exit surface, wherein the light source is configured to provide light source light emanating from the cavity opening of the at least one given cavity and the light source is disposed at the cavity back end of the at least one given cavity, wherein the first cavity wall or the second cavity wall hide the light exit surface of the light source when the acoustic panel is viewed along a normal to the acoustic panel, and wherein the acoustic panel further comprises sound reducing material.

16. The lighting system of claim 15, wherein the divider wall is configured such that said light source provides task lighting that illuminates the desk directly from the light exit surface.

17. The lighting system of claim 16, wherein the at least one acoustic panel comprises:

a support frame which holds the light source at the cavity back end of the at least one given cavity, wherein the first cavity wall and the second cavity wall of the at least one given cavity taper to the cavity back end of the at least one given cavity and define a cavity opening angle ($\gamma$) having a value in the range of $0° < \gamma < 90°$.

18. The lighting system of claim 16, wherein the divider wall is a desk divider or a room divider.

* * * * *